US008539879B2

(12) United States Patent
Dickinson et al.

(10) Patent No.: US 8,539,879 B2
(45) Date of Patent: Sep. 24, 2013

(54) DEVICES AND METHODS FOR PRINTMAKING ON CANVAS

(76) Inventors: John Michael Dickinson, Newport Beach, CA (US); Carol J. Basile, Newport Beach, CA (US)

( * ) Notice: Subject to any disclaimer, the term of this patent is extended or adjusted under 35 U.S.C. 154(b) by 0 days.

(21) Appl. No.: 13/374,001

(22) Filed: Dec. 5, 2011

(65) Prior Publication Data

US 2012/0145022 A1 Jun. 14, 2012

Related U.S. Application Data

(63) Continuation-in-part of application No. 12/840,052, filed on Jul. 20, 2010, now abandoned.

(60) Provisional application No. 61/352,734, filed on Jun. 8, 2010.

(51) Int. Cl.

| | |
|---|---|
| ***B41F 3/36*** | (2006.01) |
| ***B41F 19/02*** | (2006.01) |
| ***B31F 1/07*** | (2006.01) |
| ***B44B 5/00*** | (2006.01) |
| ***B41M 1/10*** | (2006.01) |

(52) U.S. Cl.
USPC ..... 101/158; 101/3.1; 101/170

(58) Field of Classification Search
USPC ..... 101/150, 158, 170, 3.1
See application file for complete search history.

(56) References Cited

U.S. PATENT DOCUMENTS

| | | | | |
|---|---|---|---|---|
| 1,543,200 | A * | 6/1925 | Ball | 101/23 |
| 1,661,573 | A * | 3/1928 | Mitchell | 428/156 |
| 1,680,097 | A * | 8/1928 | Eaton | 101/395 |
| 3,304,861 | A * | 2/1967 | Magid | 101/152 |
| 4,894,306 | A * | 1/1990 | Schubring | 430/53 |
| 6,216,590 | B1 * | 4/2001 | Whelan | 101/158 |
| 2008/0250953 | A1 * | 10/2008 | Whelan | 101/158 |

OTHER PUBLICATIONS

Manly Banister, Practical Guide to Etching and Other Intaglio Printmaking Techniques, Oct. 1, 1986.*
John Maitland Graves, All You Ever Wanted to Know About Etching Presses, Apr. 14, 2003.*
Extending Press Beds . . . Alternatives for Blankets etc with portions published on various dates ranging from Jun. 22, 2009 to Jul. 19, 2009.*
Printingmaking: Intaglio published on Nov. 2, 2007.*
Rembrandt and the Technique of Etching from Ed de Heer, "Technique of Etching" in Nel Segno d Rembrandt published in 1999.*

* cited by examiner

*Primary Examiner* — Ren Yan
*Assistant Examiner* — Blake A Tankersley
(74) *Attorney, Agent, or Firm* — Knobbe Martens Olson & Bear, LLP

(57) ABSTRACT

Devices and methods for printmaking on canvas are described herein. The devices and methods provide advantages that include permanent printmaking on canvas.

12 Claims, 7 Drawing Sheets

DEVICES AND METHODS FOR PRINTMAKING ON CANVAS

CROSS-REFERENCE TO RELATED APPLICATIONS

This application is a continuation-in-part of U.S. patent application Ser. No. 12/840,052, filed on Jul. 20, 2010, now abandoned which claims the benefit of priority under 35 U.S.C.§ of U.S. Provisional Patent Application No. 61/352,734, filed Jun. 8, 2010, each of which is hereby incorporated herein by reference in its entirety to be considered part of this specification.

BACKGROUND

1. Field of the Invention

The present invention generally relates to printmaking. More particularly, the present invention relates to methods and apparatuses used for printmaking on heavy fabric media.

2. Description of the Related Art

In the art world, intaglio generally refers to a number of techniques that create an image by cutting, carving or engraving the image into a flat surface of a plate or matrix. The plate typically is a copper or zinc plate. The image can be created in the plate by any of a variety of techniques, such as etching, engraving, drypoint, aquatint, stipple, mezzotint, embossing, monotype, and certain forms of plate lithography. The image created in the plate comprises grooves and other voids that are filled with ink.

The paper media then is pressed against the plate. The paper media picks up the ink from the grooves during a pressing process. The pressing process also results in a tactile image being formed in that the paper media physically reflects the grooves and voids from the plate. Further, the physical outline of the plate also is transferred to the paper. Thus, following the pressing process, the paper media maintains an outer plate line, an artistic surface relief pattern and the transferred ink image.

SUMMARY

Intaglio, however, has been limited to paper and, as such, is a paper-based art technique. Many other art forms, such as painting, take advantage of some of the characteristics of heavy fabrics, such as canvas. Unfortunately, canvas is too heavy of a material for conventional intaglio and the canvas does not take and retain the shapes from the underlying plate using normal intaglio techniques. Accordingly, there is a need for apparatus, systems, and methods that can create intaglio prints on canvas. In addition, many of the techniques also can be used for other forms of printmaking.

BRIEF DESCRIPTION OF THE DRAWINGS

These and other features, embodiments, and advantages of the present invention will now be described in connection with preferred embodiments of the invention, in reference to the accompanying drawings. The illustrated embodiments, however, are merely examples and are not intended to limit the invention.

DETAILED DESCRIPTION

Figure 1:
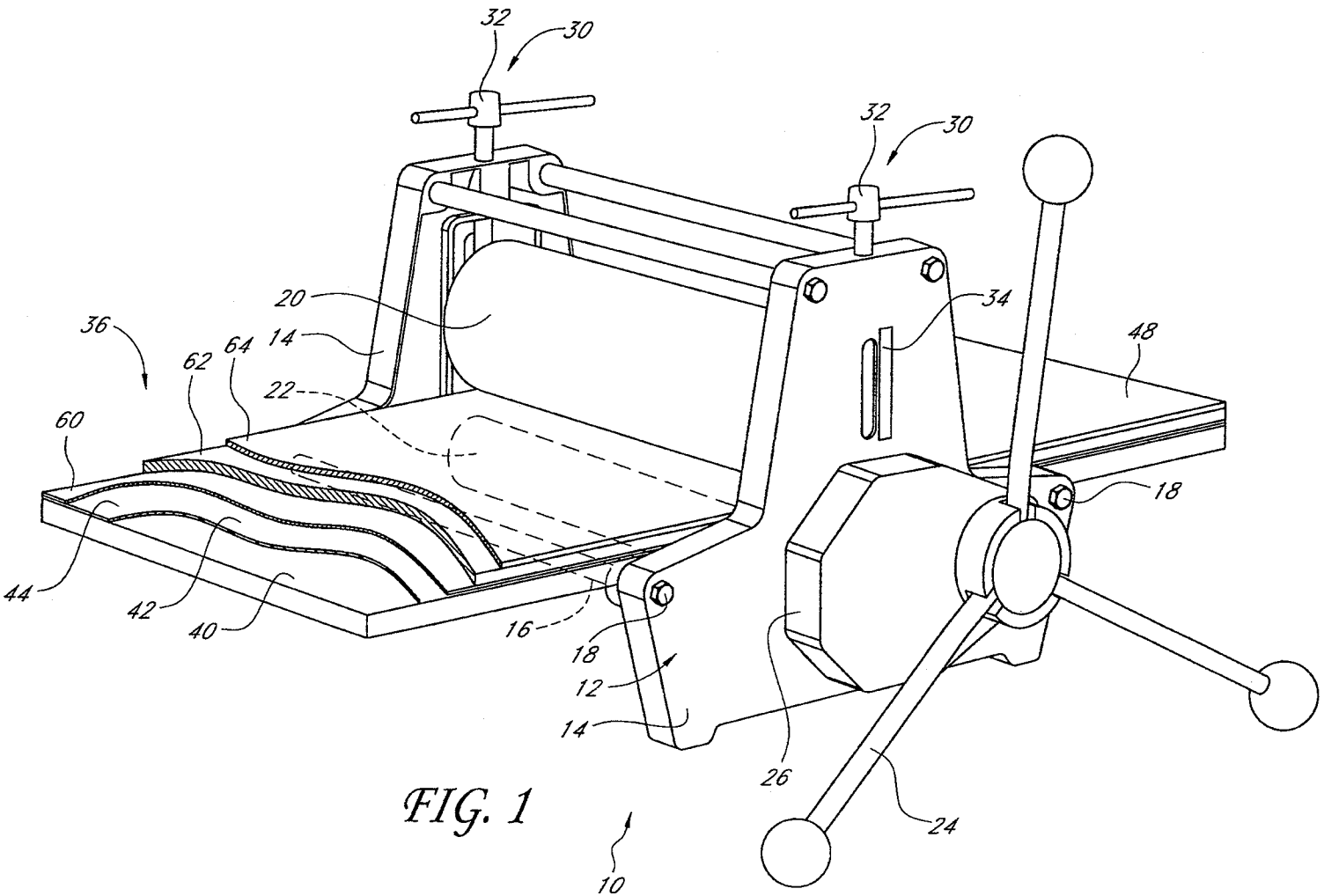
FIG. 1 is a perspective view of an etching press that is arranged and configured in accordance with certain features, aspects and advantages of the present invention.

FIG. 1 illustrates an etching press 10 that is arranged and configured in accordance with certain features aspects and advantages of the present invention. While the illustrated etching press 10 is a modified Blick® 906 Etching Press available from Dick Blick Art Materials, other suitable etching press configurations also can be used. Preferably, the etching press 10 is a large, heavy duty, manually-controlled press. The illustrated etching press 10 has been modified in manners that will be explained below. The modifications, in part, enable the etching press 10 to create prints in heavy fabric materials.

The illustrated etching press 10 comprises a frame assembly 12. The frame assembly 12 can have any suitable configuration. In the illustrated configuration, the frame assembly comprises aluminum side castings 14. The side castings 14 can be secured together with multiple connecting rods 16. In the illustrated configuration, outer connecting rods 16 are positioned at each lateral end of the side castings 14 and an intermediate connecting rod (not shown) is positioned between the outer connecting rods 16. In the illustrated configuration, threaded fasteners 18 can be used to secure the connecting rods 16 in position relative to the side castings 14. Other configurations are possible.

The frame assembly 12 supports an upper roller 20 and a lower roller 22. The upper roller 20 and the lower roller 22 are supported by suitable bearing configurations and each of the upper roller 20 and the lower roller 22 generally extends between the side castings 14. The illustrated upper roller 20 comprises a 4 inch diameter, lathe-turned steel roll, which is generally non-collapsible. The illustrated lower roller 22 comprises a 2 inch diameter, solid lathe-turned steel roll. Other sizes and configurations can be used.

A handwheel 24 connects to a gear train (not shown) that drives the lower roller 22. The handwheel 24 can comprise three points, or handles, such as the illustrated embodiment, or can comprise any other suitable configuration. The gear train (not shown) is positioned within a housing 26 and, in some embodiments, the gear train can provide about a 2.65:1 gear ratio. Other gear ratios also can be used. Rotation of the handwheel 24 results in direct drive movement of the lower roller 22. Thus, movement of the lower roller 22 is directly controlled by rotation of the handwheel 24. Fast rotation of the handwheel 24 results in fast movement of the lower roller 22 and slow rotation of the handwheel 24 results in slow movement of the lower roller 22.

The upper roller 20 is generally vertically translatable relative to the side castings 14 while the lower roller 22 is generally vertically fixed relative to the side castings 14. Thus, the upper roller 20 can be moved toward and away from the lower roller 22. In the illustrated configuration, the position of the upper roller 20 relative to the lower roller 22 (i.e., the spacing between the upper roller 20 and the lower roller 22) can be adjusted using two calibrated pressure adjusters 30. In the illustrated configuration, each of the pressure adjusters 30 comprises a sliding T-handle 32 that can be turned to move the upper roller 20 up and down relative to the lower roller 22. In some embodiments, clearance between the upper roller 20 and the lower roller 22 can be as much as 2 inches or more.

Movement of the upper roller 20 can be monitored using gauges 34 (one shown) that are mounted to the side castings 14 and that show movement using the pressure adjusters 30. Movement of the upper roller 20 changes a pressure applied between the upper roller 20 and the lower roller 22. The gauges 34 allow a user to see a representation of how much pressure is being applied by the upper roller 20 and the lower roller 22. In some configurations, the gauges provide a scale in 1/16's of an inch. Other configurations also can be used.

A press bed 36 can be supported by the connecting rods 16 and passes between the upper roller 20 and the lower roller 22. Preferably, the press bed 36 is supported by the connecting rods 16 at the outer extremes of the frame assembly 12 and by the lower roller 22 in a more central portion of the frame assembly 12. With the press bed 36 supported on the lower roller 22, movement of the lower roller 22 controls movement of the press bed 36. Thus, movement of the handwheel 24 results in movement of the press bed 36.

Figure 2:
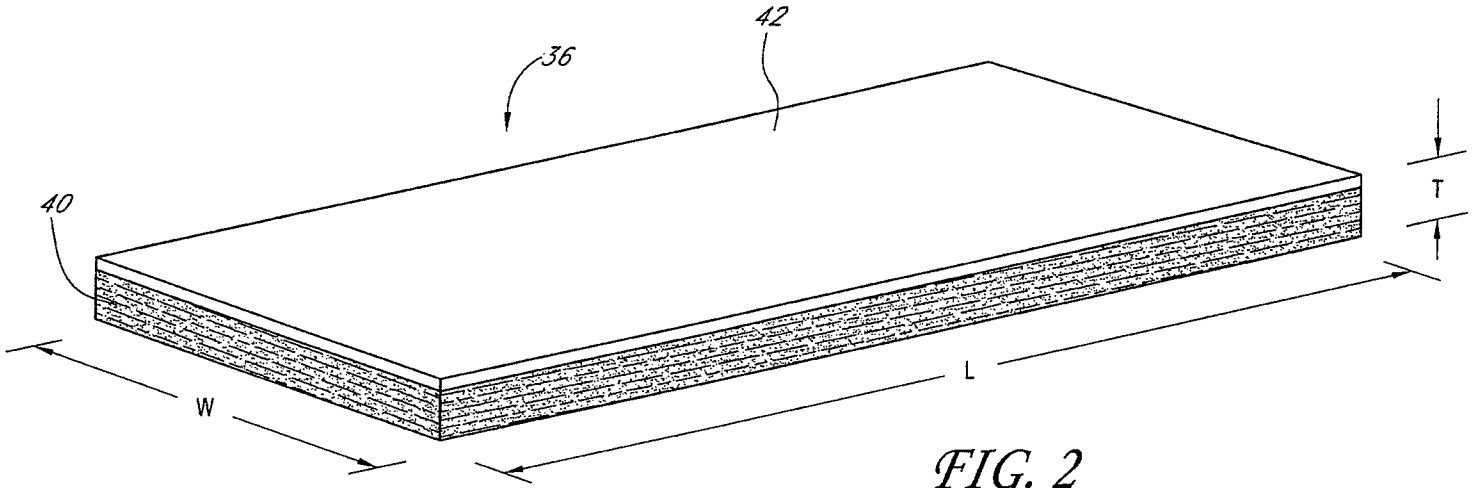
FIG. 2 is a perspective view of a press bed usable with the etching press of FIG. 1.

With reference to FIG. 2, the illustrated press bed 36 preferably comprises a body 40 that comprises a pressed wood construction. In some configurations, the press bed 36 also comprises a laminate top 42. Previous press beds were formed of steel, composite or phenolic materials. As such, the press beds were not capable of bending, compressing or deforming. In other words, the prior press beds were generally non-compliant, non-compressible and had a thin construction, which occupied very little of the distance available between the upper roller 20 and the lower roller 22

The illustrated press bed 36 accommodates high pressure loads due to the compressibility of the pressed wood construction of the body 40. While the illustrated configuration comprises the pressed wood body 40 with the laminate top 42, other types of engineered products also can be used keeping in mind the desire for compressibility in the press bed 36 while also providing a smooth supporting top 42.

Preferably, the body 40 of the press bed 36 comprises an engineered wood product that is made out of wood fibers and, in some embodiments, can comprise particle board or medium-density fiberboard. The engineered wood product can comprise resins that hold the wood product together and can comprise any of a number of cellulosic fiber insulating boards. More preferably, the press bed 36 comprises at least one surface (e.g., the top 42) that is covered with a skin, such as a polyvinyl chloride or the like. The skin 42 provides a smooth support surface while the body 40 provides a relatively softer portion that can deform under significant loads (e.g., 300 psi or more) applied by the upper roller 20 and the lower roller 22. The ability of the body 40 to deform in compression provides protection to the other components of the etching press 10 and the components used to form the artwork because the body 40 provides some compliance in an otherwise generally noncompliant system.

With reference again to FIG. 1, the press bed 36 comprises a top surface 44, a bottom surface 46, a leading edge 48, a trailing edge 50, a first side edge 52, and a second side edge 54. In the illustrated configuration, the bottom surface 46 of the press bed rests atop the lower roller 22 and the upper surface 44 faces the upper roller 20. The press bed 36 can have any suitable size. In the illustrated configuration, the press bed 36 has a width W of about 12.75 inches and a length L of about 26 inches or 36 inches. The illustrated press bed 36 has a thickness T of about 1 inch. The thickness T can be varied depending upon the press and the available separation between the rollers. The width W can be defined as a distance between the first side edge 52 and the second side edge 54. The length L can be defined as a distance between the leading edge 48 and the trailing edge 50. The thickness T can be defined as a distance between the top surface 44 and the bottom surface 46. The illustrated press bed 36 accommodates print sizes of about 12 inches wide by about 24 inches or 34 inches long. Other dimensions for the press bed 36 also can be used.

Figure 3:
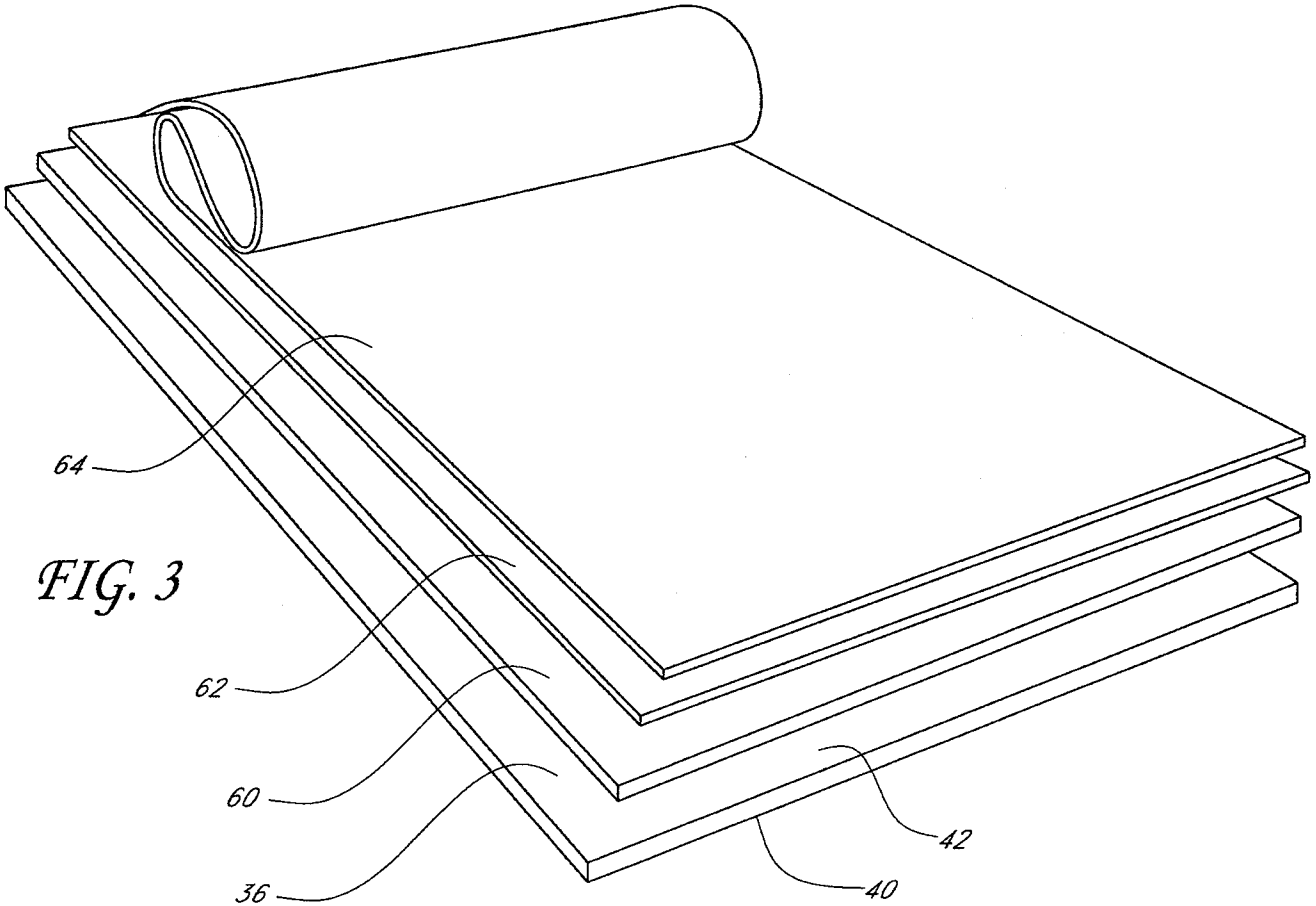
FIG. 3 is a perspective view of a stack of blankets usable with the press bed of FIG. 2.

With reference to FIG. 3, in the illustrated configuration, the etching press 10 comprises at least three blankets: a catcher 60; a cushion 62; and a pusher 64. The blankets 60, 62, 64 rest atop the top 42 of the press bed 36. While three blankets 60, 62, 64 are shown, more blankets can be used or fewer blankets can be used. The blankets 60, 62, 64 generally equalize the pressure across the lengths of the rollers 20, 22 and lessen the strain on the rollers 20, 22. Preferably, each of the blankets 60, 62, 64 is sized to completely cover the artwork being created. In most embodiments, the blankets 60, 62, 64 are sized so that they substantially cover the top surface 44 of the press bed 36 while not being large enough to impede movement of the press bed 36 through the rollers 20, 22.

The catcher 60 is used to catch overflow of paints and inks during operation of the etching press 10. In some embodiments, the catcher is about 1/16 inch thick. The cushion 62 can comprise a soft, dense wool felt material or the like and adds additional compliance on an upper portion of the assembly while the body 40 provides compliance on a lower portion of the assembly. In some embodiments, the cushion 62 can be about 1/4 inch thick. The pusher 64 is used to push the assembly through the etching press 10 between the upper roller 20 and the lower roller 22. In some embodiments the pusher 64 is about 1/8 inch thick.

Figure 4:
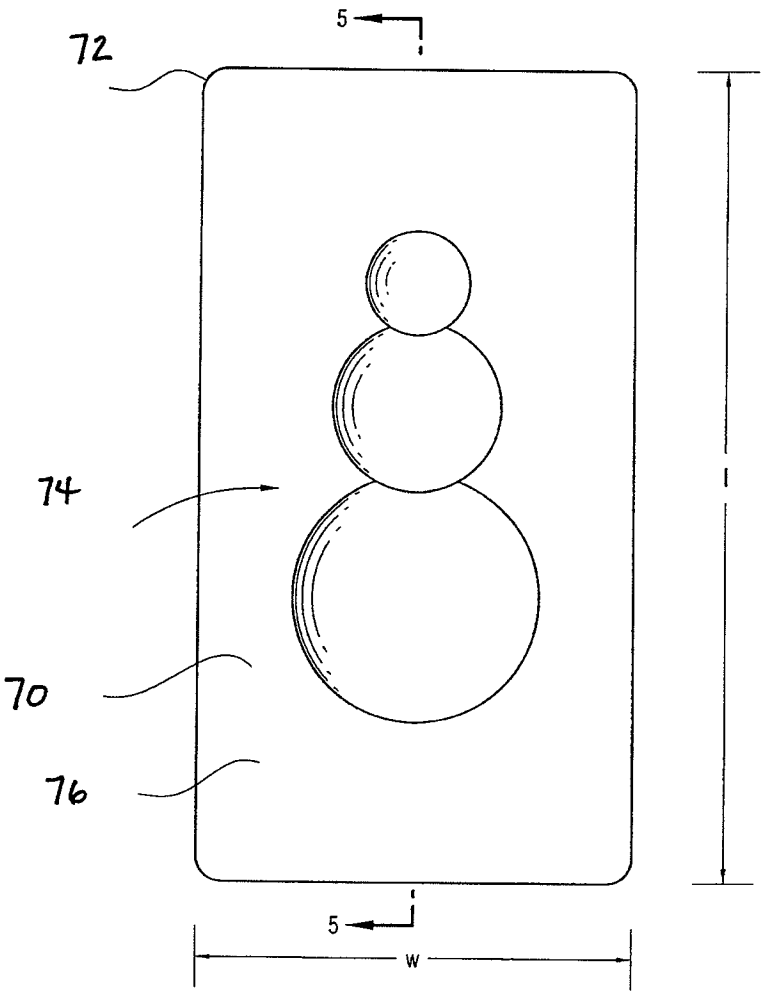
FIG. 4 is a rear view of a printing plate with an image for creation of an intaglio print.
Figure 8:
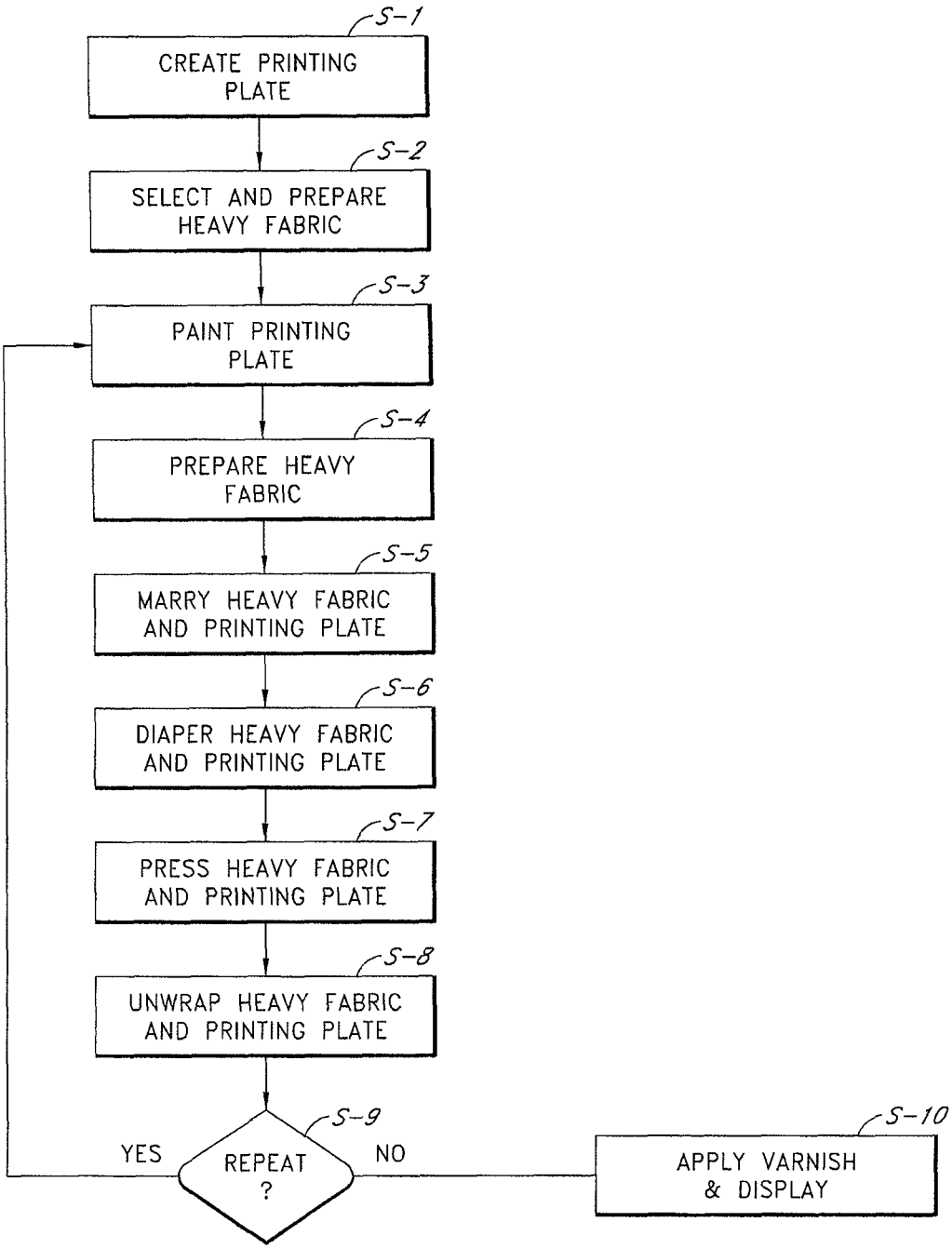
FIG. 8 is a flow-chart relating to a process of preparing the artwork shown in FIG. 7.

FIG. 4 illustrates a printing plate 70 usable with the etching press 10 of FIG. 1. With reference to FIG. 8, creating the printing plate is one of the first steps S-1 in creating the print described herein. The printing plate 70 can be formed from any suitable material. In the illustrated configuration, the printing plate 70 is formed of acrylic. Traditionally, the printing plates are metal plates having a thickness of about 1/16 inch or about 0.064 inch. In particular, traditional printing plates were formed of softer metals, such as zinc or copper, for increased workability. Over time, the printing plates were formed from acrylic plates such that etching of the plates could be performed without caustic acids. The acrylic plates also had a thickness of about 1/16 inch or about 0.064 inch. These printing plates were used for intaglio or etching on paper.

Due to the pressures involved and the desire to transfer three-dimensional images to relatively less deformable heavy fabric materials, such as canvas, some embodiments of the present invention employ a thicker than normal printing plate 70. The thicker printing plate 70 is less likely to fracture under the high pressure loads experienced and provides a thicker base material such that deeper recessed patterns can be formed within the base material without creating a hole in the printing plate 70. In some embodiments, the printing plate 70 comprises a thickness of about 3/8 inch or more. The thicker printing plate 70, however, is more likely to cause damage to an unmodified etching press and, therefore, one of ordinary skill in the art at the time of the invention was unlikely to have selected a thicker printing plate for use in the formation of prints in a heavy fabric material. Any suitable size of printing plate can be used keeping in mind a desire to reduce the likelihood of cracking of the printing plate at pressures that may exceed about 300 psi and a countervailing desire to reduce the likelihood of compromising the expensive etching press 10.

The printing plate 70 can have any suitable shape. In the illustrated configuration, the printing plate 70 has a generally rectangular configuration with a length l and a width w. Preferably, any corner 72 formed on the printing plate 70 is rounded. The rounded corners 72 reduce the likelihood of the printing plate 70 fracturing under load and also reduce the likelihood of the corners 72 of the printing plate 70 piercing or tearing the heavy fabric used during the printing process.

A thickness t of the printing plate 70 can be a distance from an etching surface 76 to a rear surface 78. The etching surface 76 is the surface that will be used to transfer designs during a printing operation. As explained directly above, the thickness t of the illustrated printing plate 70 preferably is about ⅜ inch but can be larger or slightly smaller if desired. More preferably, the printing plate 70 has a thickness t of more than about 0.07 inch and less than about 0.5 inch. The length l of the printing plate 70 preferably is substantially less than the length L of the press bed 36 and the width w of the printing plate 70 preferably is substantially less than the width W of the press bed 36.

As shown in FIG. 4, the printing plate 70 can receive a recessed design 74 in the etching surface 76. The design also can be formed in any other suitable manner, such as by adding material to the printing plate 70 or by removing material from the printing plate 70. By adding or removing material, the design can be formed as a surface relief feature.

Figure 5:
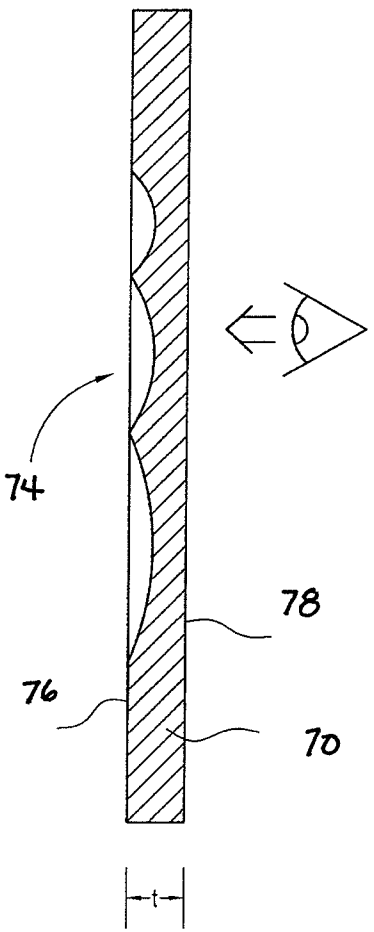
FIG. 5 is a cross-sectional view of the printing plate with the image taken along line 5-5 in FIG. 4.

Generally speaking, the recessed design 74 can be developed in any suitable manner. Once the recessed design 74 has been developed and sketched, the design can be scratched into the etching surface 76 of the printing plate 70 by laying the printing plate 70 atop of the sketch of the desired recessed design 74. The recessed design 74 corresponds to a negative of a relief image desired to be formed on the final artwork. In other words, the relief and image formed on the final artwork will be reversed from the recessed design 74 formed within the printing plate 70. For example, the relief in the image that will be formed at the end of printing will have the appearance of the image presented by the recess 74 when looking at the back surface of the printing plate 70 from the eye shown in FIG. 5.

The recessed design 74 within the printing plate 70 can be formed using any suitable tools. For example, grooves and other forms of recessed design 74 can be formed using scrapers, knifes, sanders, dental tools, or any other tool that can be used to remove material. In some embodiments, traditional drypoint etching tools can be used, such as picks and other sharp or abrasive tools and materials. A printing plate may also be incised through the use of modern manufacturing and design techniques including CAD/Cam software and modern machinery. Any other suitable tool can be used keeping in mind the desire to remove materials from the printing plate 70 during formation of the recessed design 74. The grooves and patterns of the recessed design 74 formed within the printing plate 70 are used to catch paint or other colorants used during formation of the artwork image. Moreover, the grooves and patterns of the recessed design 74 allow deformation of the heavy fabric into the recesses to pick up paint and colorants and to create a three-dimensional relief in the heavy fabric. Once the recessed design 74 has been transferred into the etching surface 76, the printing plate 70 can be inspected for unwanted burs, blemishes or other imperfections. The burs, blemishes and imperfections can be polished away and then the printing plate 70 can be cleaned with a mild soap or the like.

Other embodiments can employ printing plates 70 without a recessed design 74 in order to be suitable for other printmaking techniques, such as monotype and collagraph printmaking, or with a combination of recessed design portions and non-recessed design portions. In some embodiments, the printing plate 70 can comprise a planographic surface suitable for monotype printmaking. The planographic surface of a printing plate 70 for use in monotype printing is substantially featureless and smooth with no incisions, protrusions, or etching. Paint, ink, another suitable printing medium, or any combination thereof can be applied to the surface of the printing plate 70 and transferred to the canvas. In monotype printmaking, the canvas can be imprinted with the shape of the outside of the plate such that some degree of relief is provided to the finished project.

In other embodiments, the printing plate 70 can comprise a raised surface suitable for collagraph printmaking, also known as collograph printmaking, for example but without limitation. In some configurations, portions of the plate can be removed such that a raised surface remains and defines a desired design structural element. In some configurations, a printing plate can be carved, built up out of multiple pieces, or otherwise formed to create a protruding design. For example, acrylic pieces can be formed into the desired design and secured together in any suitable manner, such as with epoxy for example but without limitation, to create the printing plate 70. Other materials can be appropriate for creating a collagraph printing plate, such as wood, carborundum, metal, etc., or some combination thereof. The printing plate 70 and raised design can be made with a thickness and material sufficient to withstand the greater pressures needed to imprint heavy fabrics, such as canvas for example but without limitation. The raised design of the printing plate 70 can be inked with a roller or paintbrush, painted with a roller or paintbrush, or otherwise coated with a suitable printing medium or combination of mediums. For example, in collagraph printmaking, the canvas can be imprinted with the raised design of the printing plate 70.

With reference again to FIG. 8, the heavy fabric 80 can be selected and prepared for printing early in the process. See S-2. The heavy fabric 80 can be a plain weave fabric formed from cotton, linen, jute, hemp or polyester. Preferably, the heavy fabric 80 is a cotton canvas. More preferably, the heavy fabric 80 is a heavy cotton duck canvas with a high thread count. Even more preferably, the heavy fabric 80 comprises Claessens linen rough texture (15 oz) oil-primed canvas. In some applications, the canvas may be double primed. Preferably, the heavy fabric 80 is a canvas material that has been double primed with an acrylic or acrylic-oil mixture. When priming, several light coats have been found desirable when compared to heavy coats.

Figure 6:
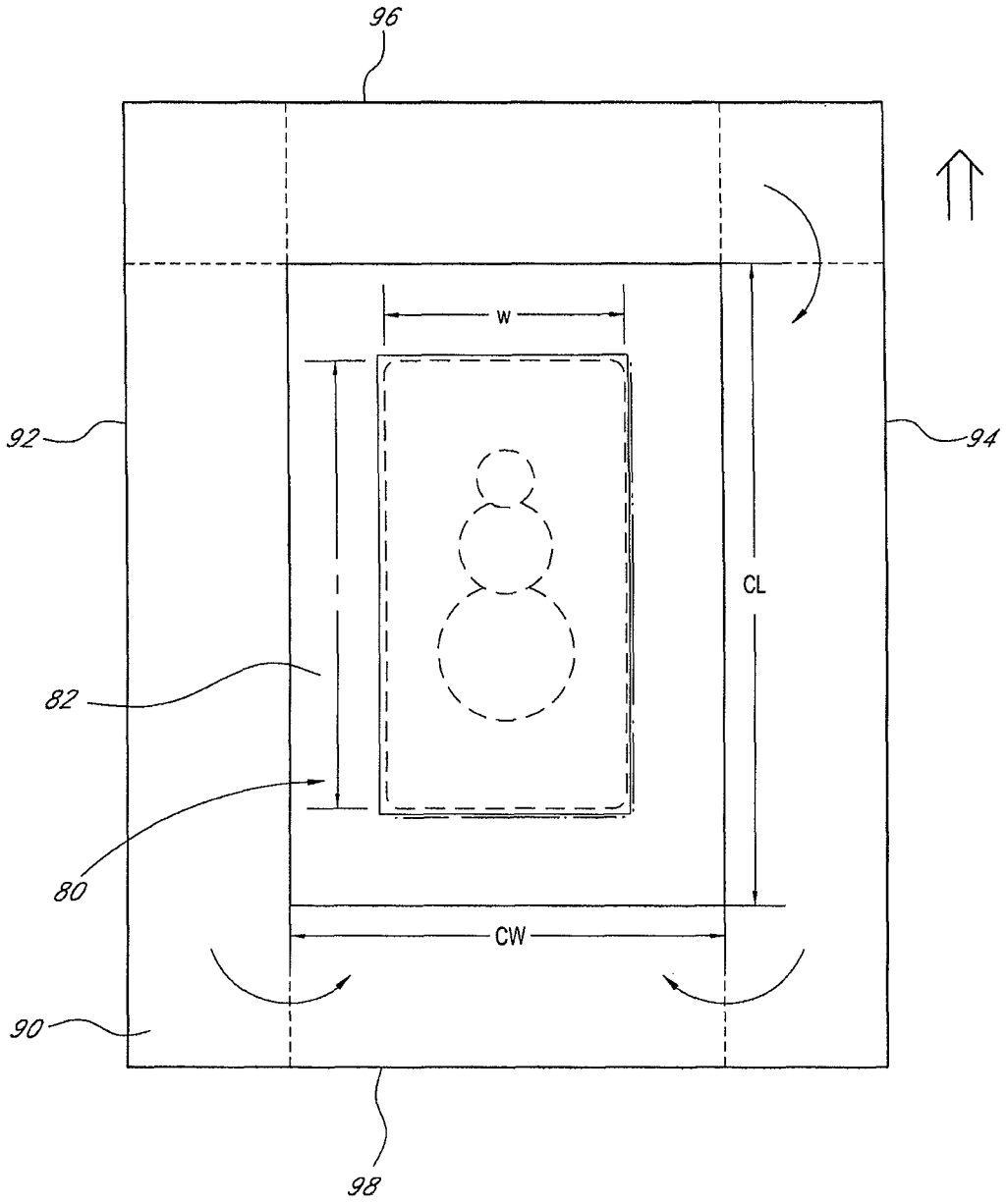
FIG. 6 is a simplified top view of an assembly of diapering materials, printing plate and heavy fabric prior to a printing operation.
Figure 7:
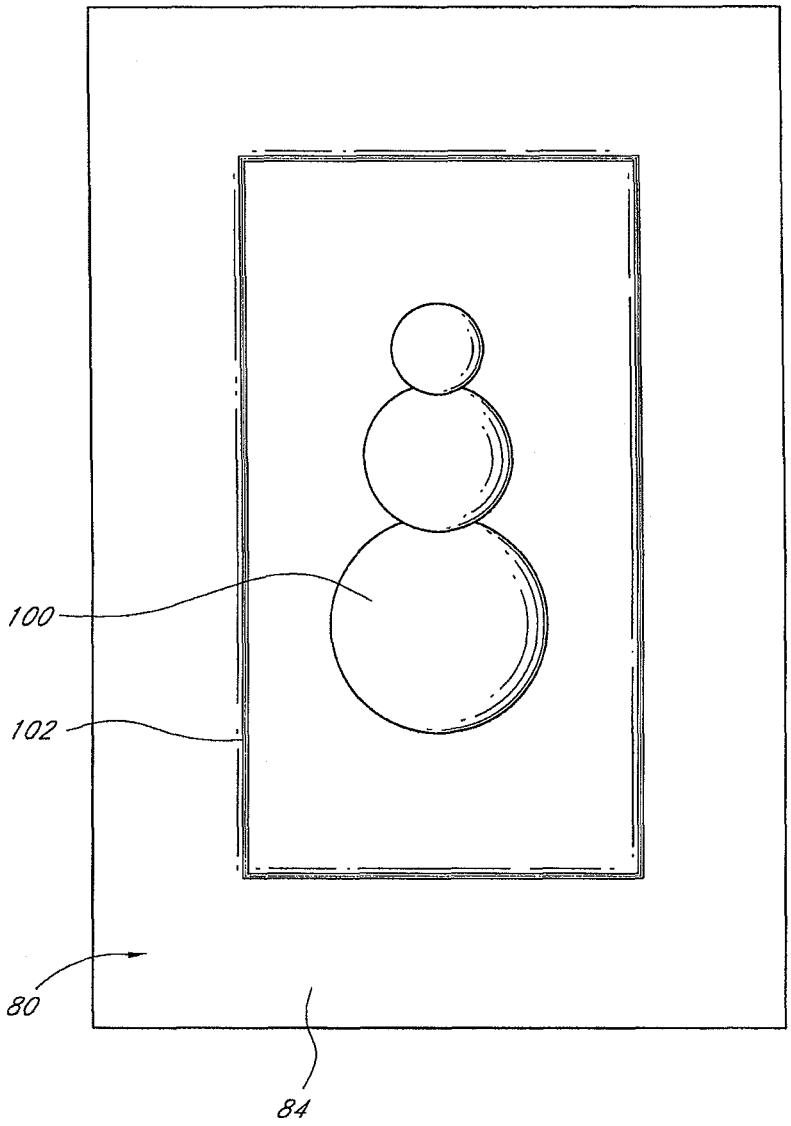
FIG. 7 is a simplified top view of artwork following the printing operation.

With reference now to FIG. 6, the heavy fabric 80 comprises a length CL, a width CW, a front or print surface 84 (see FIG. 7) and a rear or back surface 82. As used herein, the front surface is the surface that will receive printing and will abut the etched surface 76 of the printing plate 70 during printing. The length CL of the heavy fabric 80 preferably is larger than the length l of the printing plate 70 and the width CW of the heavy fabric 80 preferably is larger than the width w of the printing plate 70. In addition, the length CL of the heavy fabric 80 preferably is smaller than the length L of the press bed 36 while the width CW of the heavy fabric 80 preferably is smaller than the width W of the press bed 36.

In some embodiments, a background image (not shown) can be applied to the print face the heavy fabric 80. This background serves a primarily artistic function and thus comprises a variety of expression. The background can comprise an oil-based paint background. Preferably, the background is given sufficient time to fully dry. The background needs to be extremely dry because, under the extreme pressures involved, the background could stick to the printing plate 70 and peal off of the canvas if the background is not sufficiently dry.

Rather than ink, as is commonly used in etching and intaglio, certain aspects of the present invention relate to the use of paint in the place of ink. The inks would absorb into the paper for paper-based intaglio but, because the canvas is preferably primed, the ink could not sufficiently absorb into the canvas. In addition, due to the higher pressures involved relative to paper-based intaglio, ink tends to be displaced from regions of the printing plate 70 that contain the ink into regions of the printing plate 70 where the ink is not desired when making a heavy fabric material intaglio print. Thus, one aspect of the present invention involves the use of paints, such as heavy body paints, which give a thickened consistency relative to traditional ink. The thickened consistency helps the paint to stay in the grooves and recessed design 74 of the printing plate 70. In addition, it is believed that the paints discussed herein provide better detail and more lifelike images.

Not all paints are available as heavy body paint. Any of a variety of oil-based paints can be used when modified. The oil-based paints can be modified with additives to make them heavier, to provide faster drying and to generate more of a film. For example, additives such as thickeners, drying agents and waxes can be added to the oil-based paints to form a suitable paint media. Examples of some additives that have been found to be acceptable include Gamblin Galkyd, Daniel Smith Painting Medium for Oils and Alkyds, Dorland's Wax Medium, Gamblin Cold Wax Medium, Liquiglaze Oil Medium, Golden Extra Heavy Gel and Golden Molding Paste.

A galkyd medium also can be added to the paint. In some embodiments, the oil paint is augmented with one drop of galkyd, which amounts to about 10% volume. In some configurations, a paint medium can be added to the paint to make the paint thicker, to help the paint to dry faster and to make the paint have more of a flexible film appearance. The painting medium is approximately 10% of volume. A cold wax medium also can be added into the paint to help generate a thick film that helps keep the paint within the grooves. The cold wax can be added to about 20-25% volume. In some embodiments, the additives can be added in the following proportions: twenty to twenty-five percent volume of the paint of a thickener, ten percent volume of the paint of a drying agent, and one percent volume of the paint of a finish enhancing additive. In preferred embodiments, Gamblin Cold Wax is used as the thickener, Daniel Smith Painting Medium is used as the drying agent, and Gamblin Galkyd is used as the finish enhancing additive. A person skilled in the art will, however, recognize that a variety of thickeners, drying agents, and finish enhancing additives may be used in addition to those specifically mentioned. It has been found that too much additive will cause the paint to crack and peel later and too little additive will reduce the ability of the paint to hold the plate line and three dimensional image on the canvas. The additives and the oil paint are mixed to prepare the printing medium.

With reference again to FIG. 8, once the printing medium is selected and prepared, it is then applied to the printing plate 42. See S-3. The medium can be applied to the printing plate using a wide variety of techniques known in the art including painting, rolling, spraying, wiping or other methods. In preferred embodiments, media is applied to the printing plate 42 by painting as this enables more detailed application of color to the printing plate and presents the additional benefit of avoiding mess created by excess media on the printing plate. Painting allows for better details and more definition. Moreover, painting allows increased printing medium to be placed in regions of the etching where desired and allows limited or no printing medium to be placed in other regions of the etching. Multiple colors can be used where desired.

With continued reference to FIG. 8, prior to printing, the heavy fabric 80 is wetted with fluid and prepared for printing. See S-4. The fluid can be water and the water can be applied to any desired surface of the heavy fabric 80 to soften and prepare the heavy fabric 80 for the printing operation. In some embodiments, the heavy fabric 80 can be sprayed with water on the front or print side and then can be placed on the back side 82 in a water bath.

Preferably, the water bath comprises a starch element or other stiffening agent. In some embodiments, the spray starch is Niagra® heavy spray starch available from Phoenix Brands. Other starches or fabric stiffening agents also can be used to create what is believed to be a permanent or semi-permanent plate line and plate image. In other words, the starch element helps the cloth material to set with the plate image and the plate line around the periphery of the plate and the starch element is believed to reduce the likelihood of the cloth material relaxing and losing the plate image and the plate line.

The water bath with the stiffening agent can be prepared by pouring liquid starch into the water bath or by spraying spray starch onto the starch bath to create a floating layer of starch on the surface of the water. The heavy fabric 80 then can be placed into the starch bath with the back side 82 down toward the starch layer such that the back side 82 of the heavy fabric 80 can absorb the water and starch. The heavy fabric 80 can be placed in the starch bath for about 5 seconds to about 15 seconds.

Excess water then may be removed from the canvas 36 by wiping, blotting, or any other suitable technique. For example, blotting of excess water can be performed using extra thick paper or the like. The heavy fabric 80 can be inserted between the heavy paper blotters to remove the excess water prior to carrying out the printing process.

Diapering material 90, which can be comprised of tissue or newsprint, can be placed on top of the press bed 36. In some embodiments, 8-10 layers of tissue can be placed on top of the press bed 36. With reference to FIG. 8, the prepared print plate 70 and the prepared heavy fabric 80 then are mated together and placed on top of the diapering material 90. See S-5. The heavy fabric 80 is placed with the background-containing print surface adjoining the painted etching surface 76 of the printing plate 70. In some configurations, the positions of the printing plate 70 and the heavy fabric 80 can be reversed but the illustrated positioning is desired because it allows hand working following rolling in manners that will be discussed. In some embodiments, monotype printmaking techniques can be used, and the heavy fabric 80 can be placed with the background-containing print surface adjoining the painted flat surface of the printing plate 70. In other embodiments, collagraph printmaking techniques can be used, and the heavy fabric 80 can be placed with the background-containing print surface adjoining the painted raised design surface of the printing plate 70.

With the heavy fabric 80 and the printing plate 70 resting on the diapering material 90, the diapering material 90 can be folded over the heavy fabric 80 and the printing plate 70 to form a diaper that generally envelopes the heavy fabric 80. See S-6 in FIG. 8. As shown in FIG. 6, the diapering material 90 comprises a first lateral edge 92, a second lateral edge 94, a leading end 96 and a trailing end 98. Preferably, the lateral edges 92, 94 of the diapering material 90 fold over the heavy fabric 80 and the leading end 96 of the tissue also can be folded over the previously folded portions of the diapering material 90. Thus, the leading edge of the heavy fabric 80 and the leading edge of the printing plate 70 are enveloped within the diapering material 90.

The folded leading end 96 of the diapering material 90 preferably does not overlap the printing plate 70 or very slightly overlaps with the printing plate 70. Thus, the folded leading end 96 of the diapering material 90 creates a ramp-like structure to ease the rollers 20, 22 onto the printing plate 70 and the associated region of the heavy fabric 80. While the printing plate 70 could be shaped to have a ramp-like structure, or a separate ramp-like structure could be used, using the diapering material 90 to form the ramp allows the diapering material 90 to compress away while the printing plate 70 forms a distinctive top plate line in the heavy fabric 80. Moreover, the diapering material 90 provides more cushion as the heavy fabric 80 and the printing plate 70 pass through the rollers 20, 22. Thus, the diapering material 90 reduces the likelihood that the printing plate 70 will crack during the extreme pressures experienced during rolling.

Prior to initiating rolling, the combination of the diapering material 90, the heavy fabric 80 and the printing plate 70 are positioned on the press bed 36 and the blankets 60, 62, 64 are lowered and smoothed. The combination then is ready for rolling at an appropriate pressure. See S-7 in FIG. 8. When rolling canvas, the rollers 20, 22 are set at about 1.0 on the gauges 34 of the etching press 10. In contrast, when rolling paper using thin metal printing plates (e.g., 1/16 inch thick plates) during paper-based intaglio, the rollers are set at about 0.12 on the scale of the etching press. Thus, immense pressure is used when rolling the heavy fabric 80. If insufficient pressure is used during an initial rolling, the pressure can be increased incrementally using the pressure adjusters 30 to approach a desired pressure. With high pressure applied, rolling takes place at a slower pace.

The combined printing plate 70 and the heavy fabric 80 may be passed through the rollers 20, 22 one or several times depending on the desired amount of relief to be achieved. Generally, the more times the rollers 20, 22 are passed over the printing plate 70 and the heavy fabric 80 with increased pressure, the greater the relief in the final artwork. Greater three-dimensional relief may also be achieved by increasing the pressure exerted by the rollers 20, 22 on the printing element 58.

When rolling is complete, the blankets 60, 62, 64 can be lifted from over the diapered printing plate 70 and heavy fabric 80. As showing in S-8 in FIG. 8, the diapering material 90 can be removed and the heavy fabric 80 can be worked by hand into the recesses 74 on the etching surface 76 of the printing plate 70 to pick up additional paint. Working by hand, as used herein, means pressing into recesses, grooves or the like with hands or different instruments. Preferably, working by hand takes place while the heavy fabric 80 still is slightly damp from the starch bath. In some applications, rolling can be repeated before or after working by hand.

As shown at S-9 in FIG. 8, following the initial rolling, additional iterations can take place. For example, in some applications, the steps can be repeated more than 10 or 15 times. When repeating the steps, the paint can be applied to selected portions of the printing plate 70. For example, during the repeat steps, more paint can be added, different colors can be added, upper and lower shadows can be added, such that 15 or 20 process repeats can be used to create a final work of art. When completed, the final work of art is the heavy fabric 80 that comprises a three-dimensional relief 100 and a plate line 102 that encircles the relief 100. The plate line 102 clarifies that the work of art is a true print and not a mere reproduction. In some applications, one or more coats of paint also can be positioned inside of the plate line. In some embodiments, monotype printmaking techniques can be used, and multiple iterations of passing the heavy fabric 80 through the rollers 20, 22 can be used to apply additional paint from the planographic surface to the heavy fabric. When completed, the final work would comprise a plate line 102.

As shown at S-10 in FIG. 8, to prepare the completed heavy fabric 80 for final display, a protective layer can be applied thickly to the prepared side of the canvas. The protective layer can be any suitable sealant or preservative. Preferably, the protective layer is a spray varnish. In some applications, the protective layer can be a Damar varnish. Typically, about three times more than would be used on a flat canvas to allow more of the varnish to seep into the image to hold the plate line and image line, which can be seen on both sides. One or more coats of varnish are applied. In preferred embodiments, several thick coats of varnish are applied to the print.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A method of using a press to make a print on a piece of canvas, the method comprising:

selecting and preparing a piece of canvas to receive the print by placing the canvas in a water bath that comprises water and starch;

preparing a printing plate to make the print;

preparing a press to receive the printing plate and canvas;

mating the prepared canvas and the prepared printing plate together;

providing at least one protective element for the printing plate and canvas; and applying pressure to the mated printing plate and canvas, wherein the pressure applied to the printing plate and canvas makes the print on the canvas.

2. The method of claim 1 wherein the printing plate is prepared to make the print by creating a relief surface on the printing plate.

3. The method of claim 2 wherein the printing plate is prepared to make a print by applying paint to portions of the relief surface.

4. The method of claim 3 wherein the paint is heavy body oil paint or acrylic paint.

5. The method of claim 4 wherein the paint is adapted for use in printmaking by adding additives to the paint.

6. The method of claim 1 wherein the printing plate is an acrylic plate.

7. The method of claim 1 wherein the printing plate is approximately three eighths of an inch thick.

8. The method of claim 1 wherein the at least one protective element comprises at least three blankets.

9. The method of claim 1 wherein the at least one protective element comprises diaper material.

10. The method of claim 9 wherein the diaper material is wrapped around the printing plate and canvas.

11. The method of claim 1 wherein the at least one protective element comprises a flexible press bed configured to reduce the likelihood of damage to the printing plate, press or artwork during the printmaking process.

12. The method of claim 11 wherein the press bed comprises an engineered wood product with a smooth surface.

* * * * *